US008308127B1

(12) United States Patent
Harris

(10) Patent No.: US 8,308,127 B1
(45) Date of Patent: Nov. 13, 2012

(54) FAUX ICE TRAY SYSTEM

(76) Inventor: Ryan M. Harris, Tucson, AZ (US)

( * ) Notice: Subject to any disclaimer, the term of this patent is extended or adjusted under 35 U.S.C. 154(b) by 0 days.

(21) Appl. No.: 13/155,194

(22) Filed: Jun. 7, 2011

Related U.S. Application Data

(60) Provisional application No. 61/352,304, filed on Jun. 7, 2010.

(51) Int. Cl.
*F25C 1/22* (2006.01)

(52) U.S. Cl. ..... 249/117; 249/119; 249/120; 249/121; 249/131; 249/141; 249/166; 249/81; 220/23.4; 220/628; 62/457.6

(58) Field of Classification Search ..... 249/69–70, 249/79–81, 117–121, 128, 129, 131, 132, 249/141, 166–169; 220/23.4, 628; 62/457.6
See application file for complete search history.

(56) References Cited

U.S. PATENT DOCUMENTS

| | | | | | |
|---|---|---|---|---|---|
| 1,736,651 | A * | 11/1929 | Glaenzer | 220/23.4 |
| 2,495,132 | A * | 1/1950 | Remco | 220/23.4 |
| 2,498,964 | A * | 2/1950 | Roethel | 249/120 |
| 2,575,294 | A * | 11/1951 | Putorak | 220/23.4 |
| 2,614,399 | A * | 10/1952 | Roethel | 249/120 |
| 2,944,694 | A * | 7/1960 | Kinsey | 206/541 |
| 2,972,315 | A * | 2/1961 | Foerster | 425/118 |
| 3,661,353 | A * | 5/1972 | Newsteder | 249/103 |
| 4,290,408 | A * | 9/1981 | Juett et al. | 126/25 R |
| 4,886,239 | A * | 12/1989 | Stimmel | 249/117 |
| 4,982,858 | A * | 1/1991 | von Holdt | 220/23.4 |
| 5,050,755 | A * | 9/1991 | Strawder | 220/23.4 |
| 5,305,902 | A * | 4/1994 | Vozick | 220/23.4 |
| 5,339,976 | A * | 8/1994 | Thornton | 220/23.4 |
| 5,441,150 | A * | 8/1995 | Ma | 206/707 |
| 5,550,033 | A * | 8/1996 | Krumdieck | 435/40.52 |
| 6,357,720 | B1 * | 3/2002 | Shapiro et al. | 249/119 |
| 7,367,467 | B2 * | 5/2008 | Bashuk | 220/4.03 |
| 7,467,502 | B1 * | 12/2008 | Syla | 52/588.1 |
| 8,087,527 | B2 * | 1/2012 | Johnson | 220/23.4 |
| 2005/0100981 | A1 * | 5/2005 | Bjørnsen | 435/40.5 |
| 2005/0115972 | A1 * | 6/2005 | Osborn | 220/533 |
| 2006/0273084 | A1 * | 12/2006 | Baker et al. | 220/23.4 |
| 2008/0092584 | A1 * | 4/2008 | Coppin | 62/457.2 |
| 2009/0019865 | A1 * | 1/2009 | Henderson et al. | 62/62 |
| 2009/0020681 | A1 * | 1/2009 | Lee et al. | 249/110 |

* cited by examiner

*Primary Examiner* — Dimple Bodawala

(57) ABSTRACT

A faux ice tray system featuring a plurality of faux ice trays that interlock via interlock bars. The system can be placed in a refrigerated display in lieu of traditional ice or in a display cooled with another type of mechanism or with traditional ice. The trays are reversible wherein the top surface and the bottom surface can be used for containing faux ice. Some systems may feature an indentation for a bowl. Removable lids may provide an air-tight seal.

13 Claims, 6 Drawing Sheets

FAUX ICE TRAY SYSTEM

CROSS REFERENCE

This application claims priority to U.S. provisional application Ser. No. 61/352,304 filed Jun. 7, 2010, the specification of which is incorporated herein by reference in its entirety.

BACKGROUND OF THE INVENTION

Food displays with ice typically require a great deal of time to keep fresh. Ice has a tendency to melt and freeze the bottom of products in the case, making the product unattractive and unsellable. The present invention features a faux ice tray system (e.g., "Ever Ice" faux ice tray system) comprising a plurality of interlocking faux ice trays. The system can be placed in a refrigerated display in lieu of traditional ice (or in a display cooled with another type of mechanism). Or, in some embodiments, the faux ice tray system can be used in combination with traditional ice.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a faux ice tray system. In some embodiments, the system comprises at least two interlocking trays, each interlocking tray comprising a base having a bottom surface, a first side wall, a second side wall, a front wall, and a back wall that altogether form a first enclosed area adapted to hold faux ice; a concave indentation disposed in the bottom surface of the base, the concave indentation forms a second enclosed area in the bottom surface of the base, the second enclosed area is adapted to hold faux ice; a first lock channel disposed in the first side of the base and a second lock channel disposed in the second side of the base, the first lock channel and the second lock channel have a first shape; and an interlock bar having a first end, a second end, a first side portion, and a second side portion, the first side portion and the second side portion each have a second shape as viewed from the first end of the interlock bar, the second shape corresponds to the first shape such that the interlock bar can slide within the first lock channel or the second lock channel. The first side portion of the interlock bar engages the first lock channel of one interlocking tray and the second side portion of the interlock bar engages the second lock channel of the other interlocking tray.

In some embodiments, drainage holes are disposed in the interlocking tray. In some embodiments, a nametag slot adapted for displaying a tag is disposed in the first enclosed area. In some embodiments, a nametag slot adapted for displaying a tag is disposed in the second enclosed area. In some embodiments, a label recess is disposed in the front wall or in the back wall of the base, the label recess is adapted to accept a label card. In some embodiments, a bowl groove is disposed in the first enclosed area adapted to hold a bowl. In some embodiments, a first divider is removably attached to the first side of the base and extends upwardly, and a second divider is removably attached to the second side of the base and extends upwardly. In some embodiments, the dividers are removably attached to the sides of the base, respectively, via a peg-and-aperture mechanism.

In some embodiments, a lid is removably attached to the base over the first enclosed area, the lid is adapted to move between at least an open position and a closed position respectively allowing and preventing access to the first enclosed area. In some embodiments, the lid is secured to the base via a latch-and-slot mechanism. In some embodiments, the lid comprises a seal for providing an air-tight seal with the base.

In some embodiments, the interlock bar has a length as measured from the first end to the second end that is no more than a length of the base as measured from the front wall to the back wall. In some embodiments, the first lock channel and the second lock channel are generally T-shaped. In some embodiments, the first side portion and the second side portion of the interlock bar is generally T-shaped.

In some embodiments, the system comprises an interlocking tray comprising a base having a bottom surface, a first side wall, a second side wall, a front wall, and a back wall that altogether form a first enclosed area adapted to hold faux ice; a concave indentation disposed in the bottom surface of the base, the concave indentation forms a second enclosed area in the bottom surface of the base, the second enclosed area is adapted to hold faux ice; a first lock channel disposed in the first side of the base, the first lock channel has a first shape; and an interlock bar having a first end, a second end, a first side portion, and a second side portion, the first side portion has a second shape as viewed from the first end of the interlock bar, the second shape corresponds to the first shape such that the interlock bar can slide within the first lock channel.

DESCRIPTION OF PREFERRED EMBODIMENTS

Figure 1:
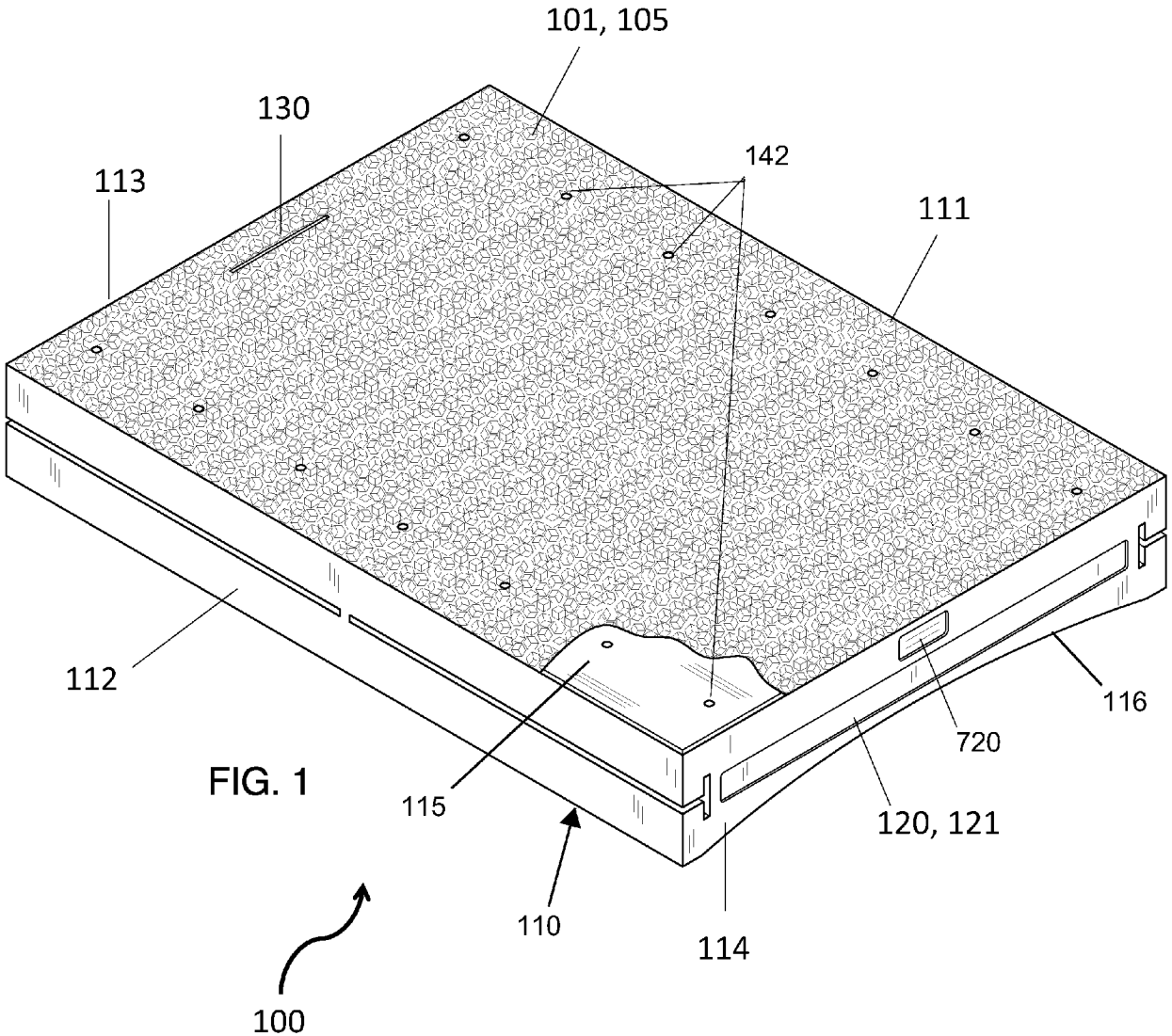
FIG. 1 is a perspective view of a tray of the "Ever Ice" faux ice tray system of the present invention.

Referring now to FIG. 1-6, the present invention features an "Ever Ice" faux ice tray system comprising a plurality of interlocking trays 100 (e.g., faux ice trays). The trays 100 (e.g., faux ice trays) each comprise a base 110 having a bottom surface, a first side wall 111, a second side wall 112, a front wall 113, a back wall 114, and a first enclosed area 105 enclosed by the bottom surface and side walls and front/back walls. The enclosed area 105 is adapted to hold faux ice 101 among other items.

Figure 2:
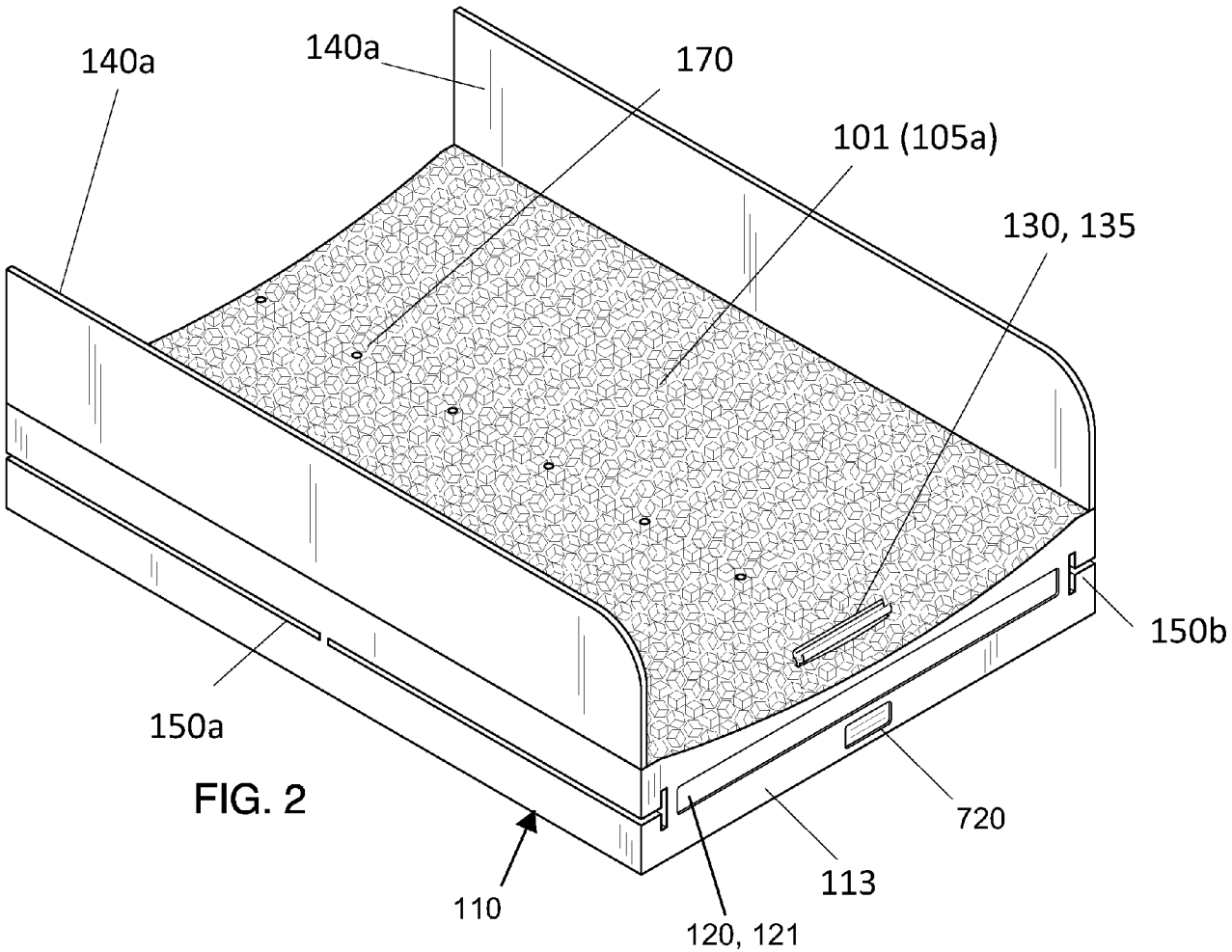
FIG. 2 is a second perspective view of a tray of the "Ever Ice" faux ice tray system of the present invention.
Figure 3:
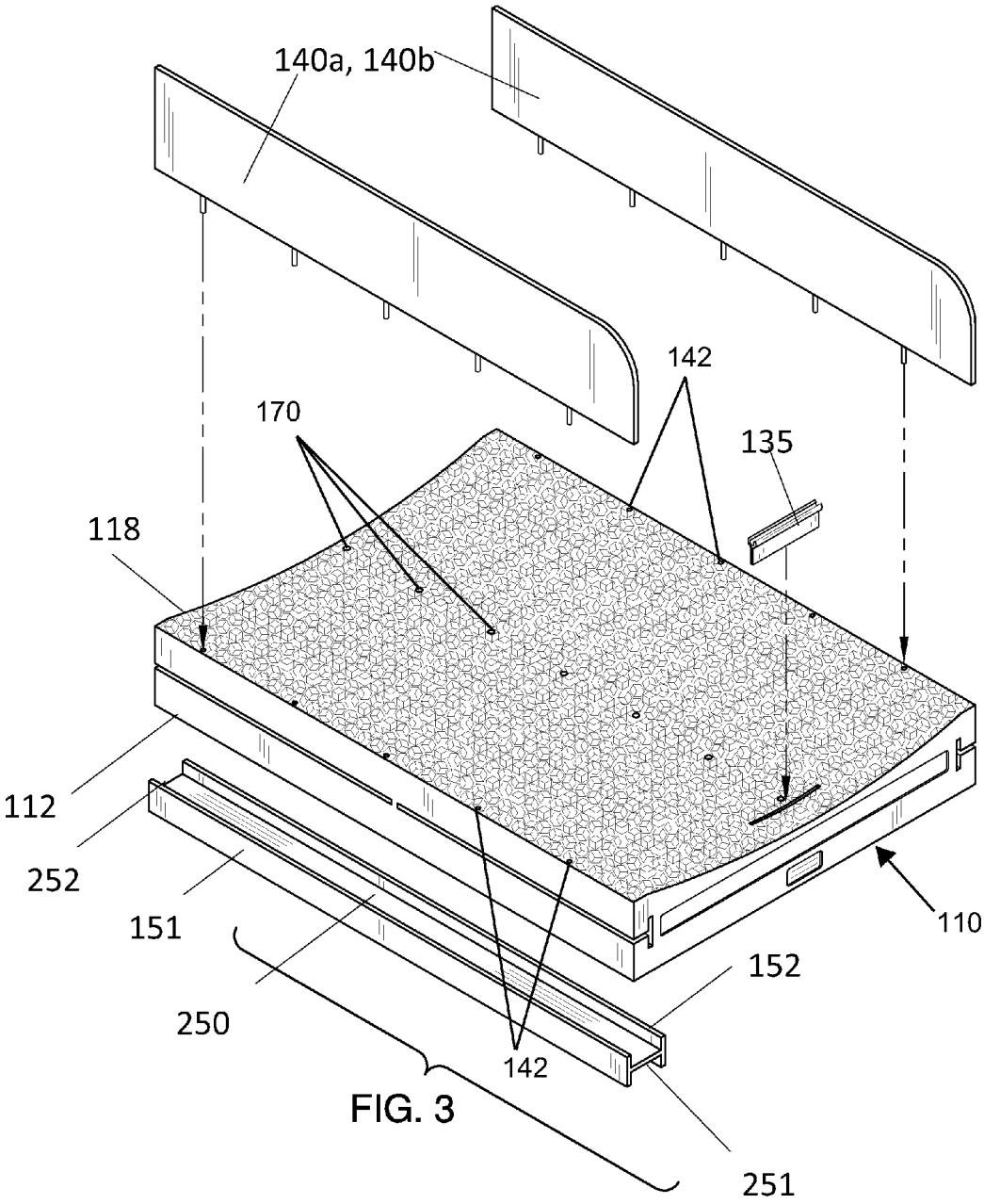
FIG. 3 is an exploded view of the tray of FIG. 2.

The trays 100 (e.g., faux ice trays) of the "Ever Ice" faux tray system of the present invention may be reversible. As shown in FIG. 2 and FIG. 3, in some embodiments, a concave indention 118 is disposed in the bottom surface of the base 110 (e.g., and the bottom edge of the front wall 113, and/or the back wall 114). The concave indention 118 may allow for space to be present below the base 110. The space may be used to accommodate an ice bed, for example if the faux ice tray 100 is placed in a cabinet display, wherein faux ice lines the bottom surface of the cabinet display (e.g., similar to what is seen in chilled food displays in grocery stores). In some embodiments, a second enclosed area 105*a* is disposed in the bottom surface of the base 110 formed by the concave indentation 118. The second enclosed area 105*a* may also be used for faux ice 101 (see FIG. 3) or any other appropriate item.

As shown in FIG. 1 and FIG. 2, in some embodiments, a label recess 120 (or a plurality of label recesses 120) is disposed in the front wall 113 and/or the back wall 114 of the base 110. The label recess 120 allows the tray 100 to be labeled and identified (e.g., with label cards 121). In some embodiments, a nametag slot 130 adapted for displaying tags 135 (e.g., food label tags for displaying food) is disposed in the first enclosed area 105 and/or the second enclosed area. In some embodiments, drainage holes 170 are disposed in the trays 100 (e.g., faux ice trays).

As shown in FIG. 2, a first divider 140*a* may be removably attached to the top or bottom edge of the first side 111 of the base 110, and a second divider 140*b* may be removably attached to the top or bottom edge of the second side 112 of the base 110. In some embodiments, the dividers help to separate items in one faux ice tray from another faux ice tray. The dividers 140*a*, 140*b* may be attached via a first attachment means, for example a snap mechanism, a button mechanism, a peg-and-aperture mechanism, the like, or a combination thereof. FIG. 3 shows the dividers 140*a*, 140*b* attached to the base 110 via a peg-and-aperture mechanism (e.g., divider holes 142 are disposed in the base 110 adapted to receive pegs on the dividers 140*a*, 140*b*.

Figure 6:
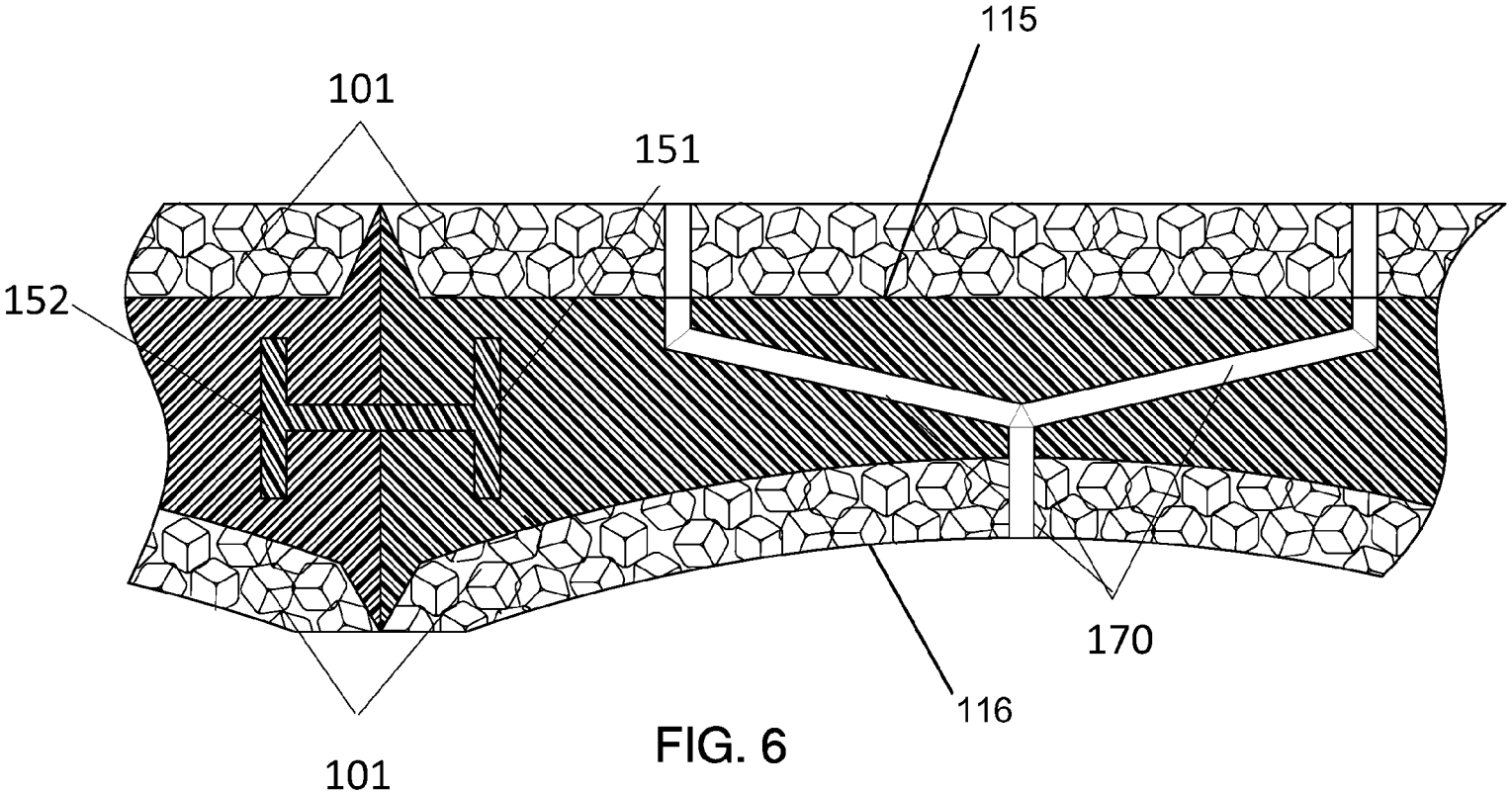
FIG. 6 is a cross sectional view of the trays of FIG. 4.

The "Ever Ice" faux ice tray system of the present invention further comprises a plurality of interlock bars 250. Each interlock bar 250 has a first end 251, a second end 252, a first side portion 151, and a second side portion 152. A first lock channel 150*a* is disposed in the first side 111 of the base 110 and a second lock channel 150*b* is disposed in the second side 112 of the base 110, wherein the lock channels 150*a*, 150*b* are each adapted to receive a side portion 151, 152 of an interlock bar 250. The interlock bars 250 can slide into the lock channels 150. For example, as shown in FIG. 6, the first side portion 151 of an interlock bar 250 can be slid into the first lock channel 150*a* of a first tray and the second side portion 152 of the interlock bar 250 can be slid into the second lock channel 150*b* of a second tray, thereby connecting the first and second tray together. In some embodiments, the lock channels 150*a*, 150*b* have a T-shape. In some embodiments, the side portions 151, 152 of the interlock bars 250 are T-shaped. The present invention is not limited to the aforementioned shapes.

The trays 100 (e.g., faux ice trays) of the "Ever Ice" faux ice tray system of the present invention may be constructed in a variety of materials, for example materials adapted to keep ice and other items cold. Such materials are well known to one of ordinary skill in the art.

The faux ice tray may have grooves and/or slots, for example, on the top surface to hold or accommodate a bowl 670 or other container (e.g., cocktail sauce). For example, in some embodiments, a bowl groove 660 is disposed in the first enclosed area 105 (or second enclosed area 105*a*) adapted to hold a bowl 670. The bowl groove 660 may be of any size or shape; the bowl 670 may be any appropriate size or shape.

Figure 4:
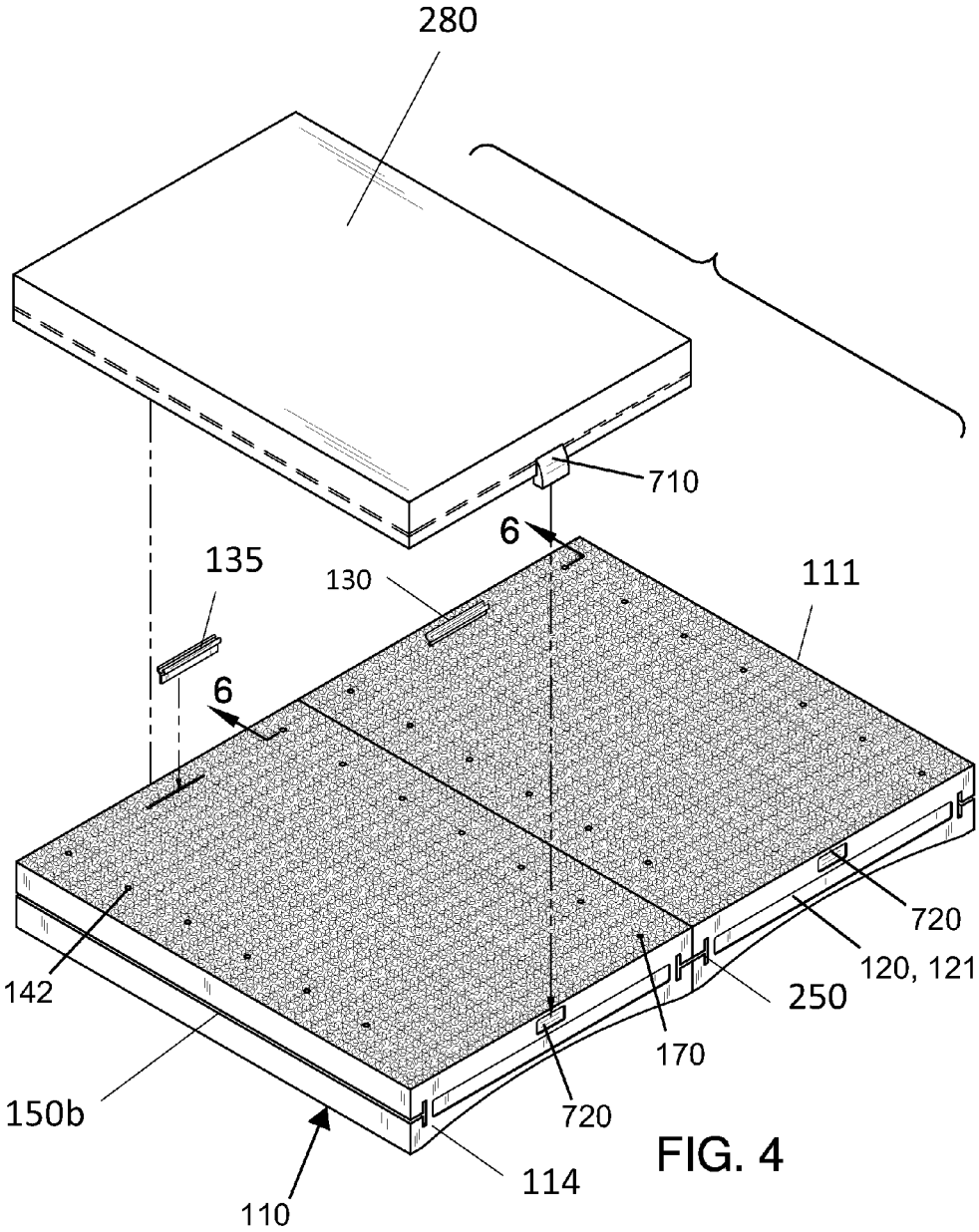
FIG. 4 is a perspective view of two trays of the "Ever Ice" faux ice tray system of the present invention.
Figure 5:
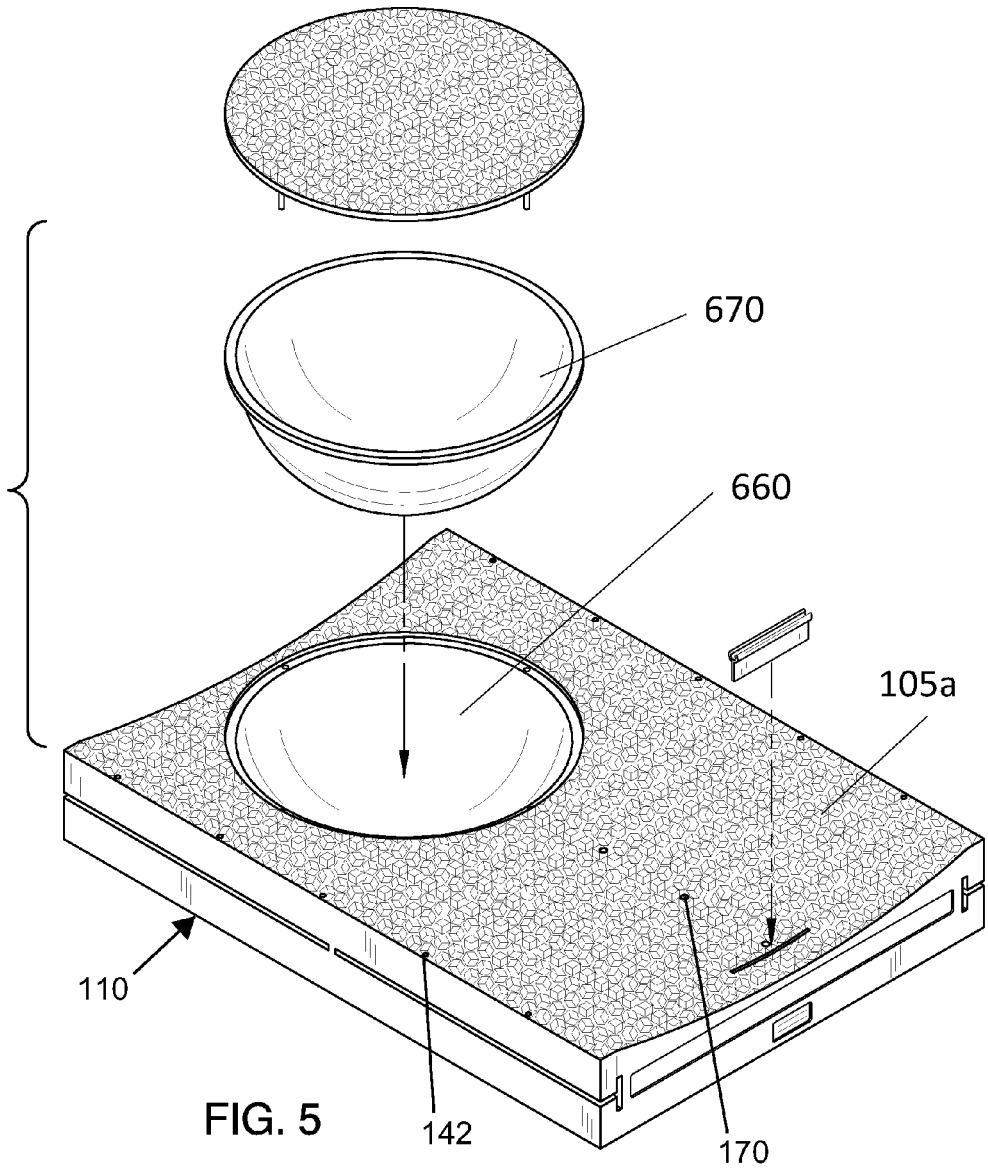
FIG. 5 is a perspective view of an alternative embodiment of the faux ice tray system of the present invention.

In some embodiments, the system of the present invention further comprises a plurality of lids 280 for covering the trays 100 (e.g., faux ice trays) (see FIG. 4). In some embodiments, the trays 100 (e.g., faux ice trays) are reversible. The lids may comprise a seal for providing an air-tight seal between the lids 280 and the base 110.

In some embodiments, a clip 710 (e.g., a latch) is disposed on the lid 280. The clip 710 is adapted to engage a lock slot 720 disposed on the base 110 (in a position corresponding to the clip 710). The clip 710 engages the lock slot 720 to hold the lid 280 in place. Such latch-and-slot mechanisms are well known to one of ordinary skill in the art.

The components of the system of the present invention may be constructed in a variety of sizes. For example, in some embodiments, the base 110 is about 10 inches in width as measured from the first side 111 to the second side 112. In some embodiments, the base 110 is about 14 inches in length as measured from the front wall 113 to the back wall 113. In some embodiments, the bowl 670 is about 5 inches in height and about 8 inches in diameter. In some embodiments, the interlock bar 250 is about 6 inches in length as measured from the first end 251 to the second end 252. The present invention is in no way limited to the aforementioned examples of dimensions.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A faux ice tray system comprising:

(a) at least two interlocking trays (100), each interlocking tray (100) comprising:

(i) a base (110) having a top surface (115), a bottom surface (116), a first side wall (111), a second side wall (112), a front wall (113), and a back wall (114), wherein the top surface (115) forms a first area (105) adapted to hold faux ice (101);

(ii) a concave indentation (118) disposed in the bottom surface (116) of the base (110), the concave indentation (118) forms a second area (105*a*) the bottom surface (116) of the base (110), such that the second area (105*a*) is located opposite to said first area (105), and is adapted to hold faux ices (101);

(iii) a first lock channel (150*a*) disposed in the first side (111) of the base (110) and a second lock channel (150*b*) disposed in the second side (112) of the base (110), the first lock channel (150*a*) and the second lock channel (150*b*) have a first shape; and (b) an interlock bar (250) having a first end (251), a second end (252), a first side portion (151), and a second side portion (152), the first side portion (151) and the second side portion (152) each have a second shape as viewed from the first end (251) of the interlock bar (250), the second shape corresponds to the first shape such that the interlock bar (250) can slide within the first lock channel (150*a*) or the second lock channel (150*b*);

wherein the first side portion (151) of the interlock bar (250) engages the first lock channel (150*a*) of one interlocking tray (100) and the second side portion (152) of the interlock bar (250) engages the second lock channel (150*b*) of the other interlocking tray (100).

2. The system of claim 1, wherein drainage holes (170) are disposed in the interlocking tray (110).

3. The system of claim 1, wherein a nametag slot (130) adapted for displaying a tag (135) is disposed in the first enclosed area (105).

4. The system of claim 1, wherein a nametag slot (130) adapted for displaying a tag (135) is disposed in the second enclosed area (105*a*).

5. The system of claim 1, wherein a label recess (120) is disposed in the front wall (113) or in the back wall (114) of the base (110), the label recess (120) is adapted to accept a label card (121).

6. The system of claim 1, wherein a first divider (140*a*) is removably attached to the first side (111) of the base (110) and extends upwardly, and a second divider (140*b*) is removably attached to the second side (112) of the base (110) and extends upwardly.

7. The system of claim 6, wherein the dividers (140*a*), (140*b*) are removably attached to the sides (111), (112) of the base (110), respectively, via a peg-and-aperture mechanism.

8. The system of claim 1, wherein a lid (280) is removably attached to the base (110) over the first enclosed area (105), the lid (280) is adapted to move between at least an open position and a closed position respectively allowing and preventing access to the first enclosed area (105).

9. The system of claim 8, wherein the lid (280) is secured to the base (110) via a latch-and-slot mechanism.

10. The system of claim 1, wherein the interlock bar (250) has a length as measured from the first end (251) to the second end (252) that is no more than a length of the base (110) as measured from the front wall (113) to the back wall (114).

11. The system of claim 1, wherein the first lock channel (150*a*) and the second lock channel (150*b*) are generally T-shaped.

12. The system of claim 1, wherein the first side portion (151) and the second side portion (152) of the interlock bar (250) is generally T-shaped.

13. A faux ice tray system comprising:

(a) an interlocking tray (100) comprising:

(i) a base (110) having a top surface (115), a bottom surface (116), a first side wall (111), a second side wall (112), a front wall (113), and a back wall (114), wherein the top surface (115) forms a first area (105) adapted to hold faux ice (101);

(ii) a concave indentation (118) disposed in the bottom surface (116) of the base (110), the concave indentation (118) forms a second area (105*a*) the bottom surface (116) of the base (110), such that the second area (105*a*) is located opposite to said first area (105), and is adapted to hold faux ices (101);

(iii) a first lock channel (150*a*) disposed in the first side (111) of the base (110), the first lock channel (150*a*) has a first shape; and (b) an interlock bar (250) having a first end (251), a second end (252), a first side portion (151), and a second side portion (152), the first side portion (151) has a second shape as viewed from the first end (251) of the interlock bar (250), the second shape corresponds to the first shape such that the interlock bar (250) can slide within the first lock channel (150*a*).

* * * * *